United States Patent [19]

Okigami et al.

[11] Patent Number: 4,496,306

[45] Date of Patent: Jan. 29, 1985

[54] MULTI-STAGE COMBUSTION METHOD FOR INHIBITING FORMATION OF NITROGEN OXIDES

[75] Inventors: Noboru Okigami; Hiroshi Hayasaka; Yoshitoshi Sekiguchi; Harushige Tamura, all of Osaka, Japan

[73] Assignee: Hitachi Shipbuilding & Engineering Co., Ltd., Osaka, Japan

[21] Appl. No.: 601,105

[22] Filed: Apr. 18, 1984

Related U.S. Application Data

[63] Continuation of Ser. No. 914,146, Jun. 9, 1978, abandoned.

[51] Int. Cl.[3] ..... F23M 3/02

[52] U.S. Cl. ..... 431/8; 431/174

[58] Field of Search ..... 431/10, 4, 5, 8, 174, 431/175, 176, 278, 283, 284, 285; 60/746

[56] References Cited

U.S. PATENT DOCUMENTS

| | | | |
|---|---|---|---|
| 1,587,100 | 6/1926 | Willett | 431/285 |
| 3,273,621 | 9/1966 | Childree | 431/284 |
| 3,376,098 | 4/1968 | Pryor | 431/284 |
| 3,727,562 | 4/1973 | Bauer | 431/10 X |
| 3,729,285 | 4/1973 | Schwedersky | 431/8 |
| 3,736,747 | 6/1973 | Warren | 60/39.65 |
| 3,848,412 | 11/1974 | Michels et al. | 431/10 X |
| 3,907,488 | 9/1975 | Takahashi et al. | 431/285 |
| 3,920,377 | 11/1975 | Yanuki et al. | 431/176 |
| 3,957,420 | 5/1976 | Asai et al. | 431/175 |
| 3,993,449 | 11/1976 | Childs | 431/5 X |
| 4,012,902 | 3/1977 | Schirmer | 431/10 X |
| 4,021,186 | 5/1977 | Tenner | 431/10 |
| 4,050,877 | 9/1977 | Craig et al. | 431/10 X |
| 4,052,844 | 10/1977 | Caruel et al. | 431/10 X |
| 4,094,625 | 6/1978 | Wang et al. | 431/284 |
| 4,095,929 | 6/1978 | McCartney | 431/175 |
| 4,113,417 | 9/1978 | Deruelle | 431/10 X |
| 4,118,171 | 10/1978 | Flanagan et al. | 431/10 |

FOREIGN PATENT DOCUMENTS

| | | | |
|---|---|---|---|
| 2421632 | 11/1975 | Fed. Rep. of Germany | 60/746 |

*Primary Examiner*—Andrew M. Dolinar
*Attorney, Agent, or Firm*—Armstrong, Nikaido, Marmelstein & Kubovcik

[57] ABSTRACT

A method comprising injecting a primary fuel and air into a furnace to burn the fuel and form a first-stage combustion zone, the air being supplied at a rate in excess of the stoichiometric rate required for the combustion of the fuel, and injecting a secondary fuel into the furnace around or downstream of the first-stage zone at a rate approximately equal to the stoichiometric rate required for the consumption of the excess oxygen resulting from the combustion in the first-stage zone the fuel being diluted with the surrounding combustion gas and to form a second-stage combustion zone around or downstream of the first-stage zone.

6 Claims, 11 Drawing Figures

MULTI-STAGE COMBUSTION METHOD FOR INHIBITING FORMATION OF NITROGEN OXIDES

This application is a continuation of application Ser. No. 914,146, filed June 9, 1978, abandoned.

BACKGROUND OF THE INVENTION

This invention relates to a multi-stage combustion method capable of effectively inhibiting the formation of nitrogen oxides.

It has been desired to provide combustion methods capable of effectively inhibiting the formation of nitrogen oxides ($NO_x$) which produce photochemical oxidants.

The nitrogen oxides formed in combustion furnaces include: (a) nitrogen monoxide (hereinafter referred to as "fuel NO") resulting from the oxidation of nitrogen components contained in various fuels, (b) nitrogen monoxide (hereinafter referred to as "prompt NO") promptly formed when hydrocarbon fuels such as fuel oil, kerosene and LPG are burned at an air ratio (the ratio of the actual air supply to the amount of air stoichiometrically required for the combustion of fuel) of about 0.5 to 1.4, permitting hydrocarbons to react with the nitrogen in the air and further to undergo several reactions, and (c) nitrogen monoxide (hereinafter referred to as "thermal NO") produced with the nitrogen and oxygen in the air react at a high temperature in the course of combustion.

Main combustion methods heretofore known for inhibiting nitrogen oxides are:

(1) A method in which air is supplied in two stages to form a first-stage combustion zone having an air ratio of up to 1.0 and a second-stage combustion zone downstream from the first-stage zone with a supplemental air supply.

(2) A method which uses a combustion furnace equipped with a pluarlity of burners and in which air is supplied to each burner at an excessive or somewhat insufficient rate relative to the fuel supply to effect combustion in a nonequivalent mode.

(3) A method in which the exhaust gas resulting from combustion is admixed with the fuel or the air for combustion by circulation.

The method (1) is unable to suppress the formation of prompt NO when the air ratio of the first-stage combustion zone is in the usual range of 0.5 to 1.0. Even if it is attempted to inhibit the formation of prompt NO to the greatest possible extent by maintaining the air ratio at about 0.5, the unburned components will react with the secondary air where it is supplied, giving prompt NO. Thus the method fails to produce the desired result. With the method (2) in which the fuel is burned at an air ratio (usually 0.6 to 1.4) at which each burner can burn the fuel independently of another, the formation of thermal NO and prompt NO inevitably results. The method (3) is not fully feasible since the exhaust gas, if circulated at an increased rate to effectively inhibit $NO_x$, will impair steady combustion.

SUMMARY OF THE INVENTION

This invention has been accomplished to overcome the problems described above. The object of the invention is to provide a multi-stage combustion method capable of effectively inhibiting the formation of $NO_x$.

The multi-stage combustion method of this invention for effecting combustion while inhibiting the formation of nitrogen oxides comprises injecting a primary fuel and primary air into a furnace to burn the fuel and form a first-stage combustion zone, the air being supplied at a rate in excess of the stoichiometric rate required for the combustion of the fuel, and injecting a secondary fuel into the furnace around or downstream of the first-stage combustion zone at a rate approximately equal to the stoichiometric rate required for the consumption of the excess oxygen resulting from the combustion in the first-stage zone to form a second-stage combustion zone around or downstream of the first-stage zone.

When the secondary fuel is supplied at a rate in excess of the stoichiometric rate required for the consumption of excess oxygen resulting from the combustion in the first stage zone, secondary air is supplied downstream of the second-stage zone at a rate not less than the stoichiometric rate required for the oxidation of the unburned components resulting from the combustion in the second-stage zone to oxidize the unburned components and form a third-stage combustion zone downstream from the second-stage zone.

DESCRIPTION OF THE PREFERRED EMBODIMENTS

Figure 1:
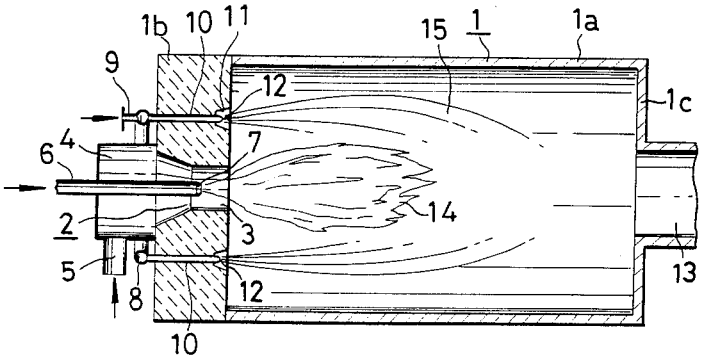
FIG. 1 is a view in vertical section showing a combustion furnace useful for the method of a first embodiment of this invention.

Throughout the drawings, like parts are referred to by like reference numerals. Further in the following description, the terms "front" and "rear" are based on FIG. 1 in which the left-hand side is referred to as front and the right-hand side as rear.

A first embodiment of the invention will now be described. FIG. 1 shows a combustion furnace useful for this embodiment.

With reference to FIG. 1, a furnace main body 1 comprises a hollow cylindrical peripheral wall 1*a*, and a front wall 1b and a rear wall 1c which are provided at the opposite ends of the wall 1a. A burner 2 mounted on the front wall 1b made of refractory material comprises an air inlet 3 formed in the corner of the front wall 1b, an air box 4 provided on the outer side of the front wall 1b and communicating with the air inlet 3, an air duct 5 connected to the air box 4, a primary fuel supply pipe 6 extending from an unillustrated fuel tank into the air inlet 3, and a primary fuel nozzle 7 provided at one end of the pipe 6 within the air inlet 3. An annular header 8 surrounds the air box 4 outside the furnace main body 1 for supplying a secondary fuel. A secondary fuel conduit 9 extends from the fuel tank to the annular header 8. A plurality of secondary fuel supply pipes 10 connected to the annular header 8 at equal spacing extend through the front wall 1b with their forward ends respectively positioned in a plurality of cavities 11 formed in the inner surface of the furnace. The secondary fuel supply pipes 10 are provided at their forward ends with secondary fuel nozzles 12, respectively. A combustion gas outlet 13 is formed in the rear wall 1c.

Air is supplied to the furnace through the air inlet 3 at a rate approximately equal to the stoichiometric rate required for the combustion of the whole fuel supply to the furnace. With the supply of the air, part of the fuel to be burned, namely primary fuel, is injected into the furnace through the nozzle 7 and burned with the burner 2, forming a first-stage combustion zone 14 within the furnace coaxially therewith.

Since the resulting heat is release from the first-stage combustion zone 14 toward the peripheral wall 1a by radiation with the combustion taking place at a high air ratio, the temperature of the zone 14 is exceedingly lower than the theoretical combustion temperature, with the result that the formation of thermal NO and prompt NO can be inhibited. If the air box 4 is provided, for example, with swivelling blades therein to give an intense circulating motion to the air, the air can be admixed with the fuel rapidly within the furnace. This serves to inhibit thermal NO and prompt NO more effectively. Further a greatly improved inhibitory effect will result when the peripheral wall 1a of the furnace is cooled with water.

Figure 5:
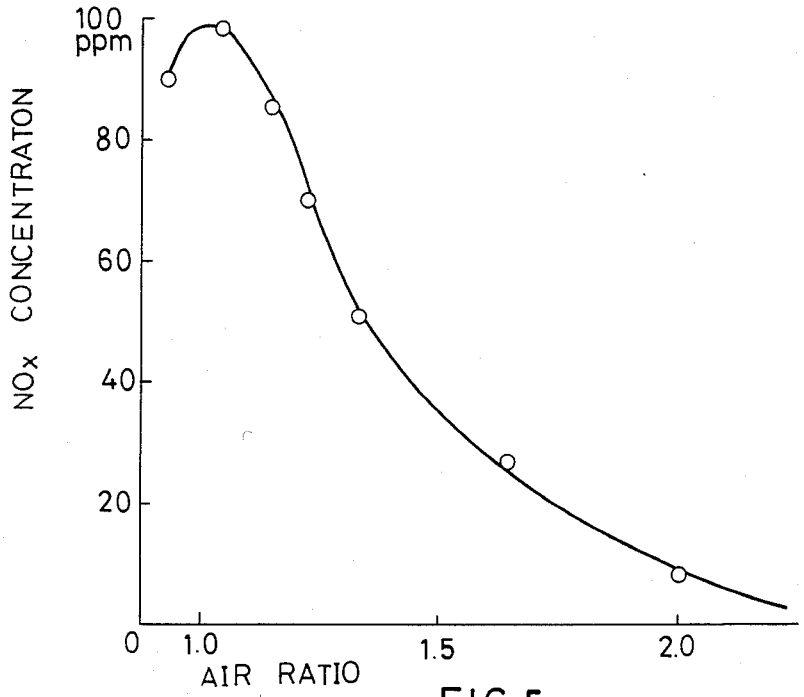
FIG. 5 is a graph showing the relation between the air ratio and the $NO_x$ concentration.

The furnace was tested for the relation between the air ratio and the $NO_x$ concentration with use of propane gas as the fuel. FIG. 5 showing the results reveals that the $NO_x$ concentration sharply decreases as the air ratio increases from 1 and that at an air ratio of at least 1.4, it lowers below 45 ppm.

With the formation of $NO_x$ thus inhibited in the first-stage combustion zone 14, the remainder of the fuel, namely secondary fuel, is injected into the furnace through the nozzles 12. Consequently the inert combustion gas surrounding the stream of injected fuel is drawn into the stream by the energy of injection, thereby diluting the injected fuel. The fuel is heated with the heat released from the first-stage combustion zone 14, mixes with the dilute excess oxygen remaining after the first-stage combustion and is moderately burned, thus forming a second-stage combustion zone 15 around the first-stage combustion zone 14. The zone 15 releases the heat toward thwe peripheral wall 1a while the combustion takes place moderately in the presence of dilute oxygen, so that the combustion temperature of the zone 15 is also much lower than the theoretical combustion temperature. Thermal NO and prompt NO are therefore inhibited. Additionally the secondary fuel, which is diluted with the inert combustion gas, is less likely to give carbon and therefore permits more effective inhibition of prompt NO.

Preferably the secondary fuel is supplied to the furnace as diluted with combustion gas. The furnace shown in FIG. 2 has a relatively large recess 16 of circular cross section formed in a lower inside portion of its front wall 1b. The furnace has a lower secondary fuel supply pipe 17 which is shorter than the other secondary fuel supply pipes 10. The supply pipe 17 is provided with a nozzle 18 on its forward end. An aspirator cylinder 19 is disposed within the recess 16 concentrically therewith, with a clearance d formed between the outer periphery of the cylinder and the inner periphery defining the recess 16. When secondary fuel is injected into the furnace through the lower nozzle 18, the inert combustion gas within the furnace is drawn by the energy of injection into the recess 16 through the clearance d to rapidly dilute the secondary fuel. Thus the secondary fuel can be supplied to the furnace in a dilute state in the case of FIG. 2. This assures an improved inhibitive effect on $NO_x$.

Figure 2:
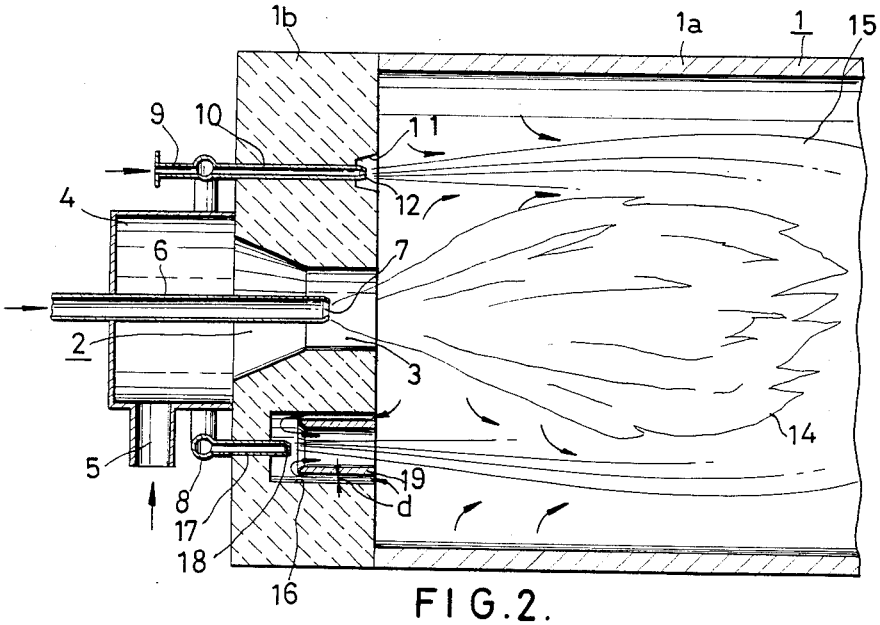
FIG. 2 is a view in vertical section showing the furnace front portion of a modification of the combustion furnace shown in FIG. 1.
Figure 6:
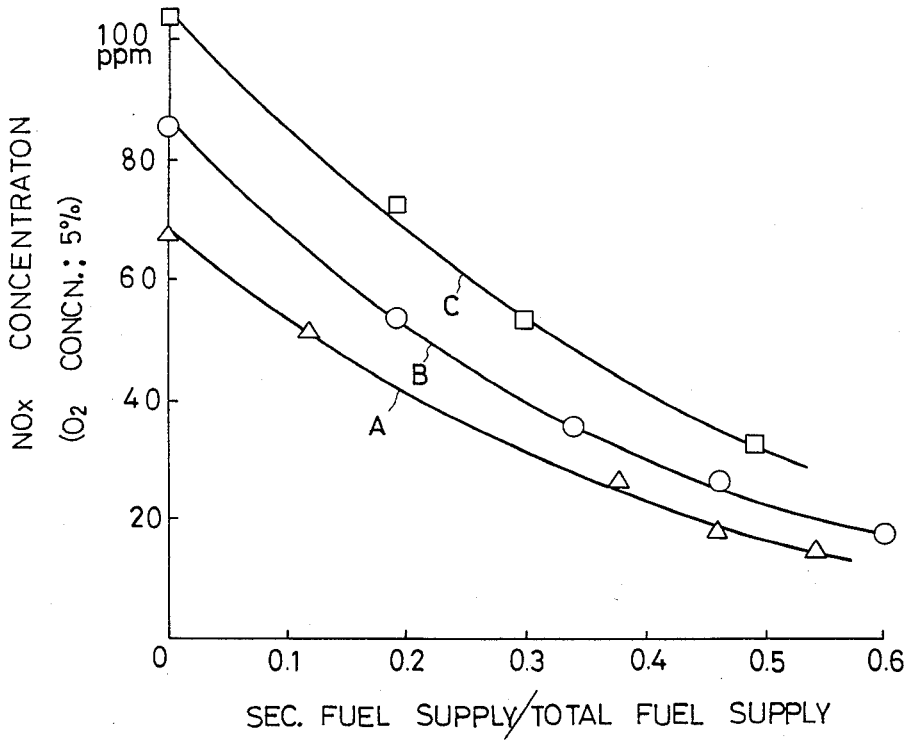
FIG. 6 is a graph showing the relation between the ratio of secondary fuel supply to total fuel supply and the $NO_x$ concentration.

The combustion furnace shown in FIG. 2 was tested for the inhibition of $NO_x$ using various hydrocarbon fuels in varying primary-to-secondary fuel supply ratios. With reference to FIG. 6 showing the teset results, Curve A represents the results achieved by the use of methane gas as the primary and secondary fuels, Curve B those achieved by the use of propane gas as the primary and secondary fuels, and Curve C those obtained with use of A fuel oil (JIS K 2205) as the primary fuel and methane gas as the secondary fuel. The heat output of the combustion furnace was $100\times10^4$ Kcal/hour, and an air ratio of 1.15 was maintained at the combustion gas outlet 13.

FIG. 6 indicates that the method of this invention effectively inhibits the formation of $NO_x$ in the case of any of the hydrocarbon fuels used. For example, when the primary fuel and secondary fuel are supplied at equal rates (at a value 0.5 on the abscissa of the graph), the amount of $NO_x$ formed is only about $\frac{1}{4}$ of the amount resulting from single-stage combustion (at an abscissa value of 0 of the graph, with use of the primary fuel only).

Figure 3:
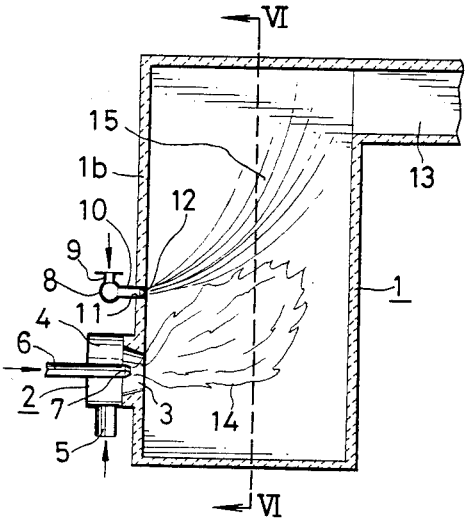
FIG. 3 is a view in vertical section showing a large-sized box furnace useful for the method of the first embodiment.
Figure 4:
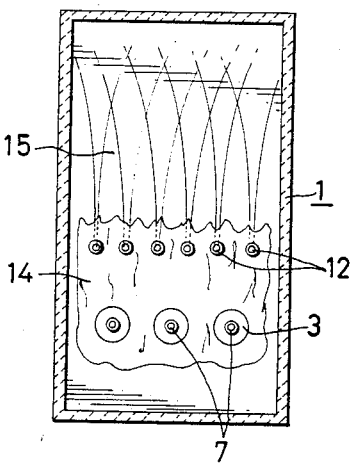
FIG. 4 is a view in section taken along the line IV—IV in FIG. 3.

The second-stage combustion zone 15, which is formed around the first-stage combustion zone 14 as described above, may alternatively be formed downstream of the combustion gas of the first-zone 14 as illustrated in FIGS. 3 and 4. The combustion furnace shown in these drawings is a large-sized box furnace. The front wall 1b of the furnace is provided with three burners 2 each having a primary fuel nozzle 7 and arranged horizontally in a row at its lower portion. Six secondary fuel nozzle 12 are arranged in a row above and in parallel to the low of the burners 2. The furnace has a combustion gas outlet 13 at a rear upper portion of the furnace and a straight tubular header 8 for supplying a secondary fuel. The primary fuel introduced into the furnace is burned with the burners 2, forming a first-stage combustion zone 14 within the furnace in its lower portion. The secondary fuel supplied through the nozzles 12 forms a second-stage combustion zone 15 above the first-stage zone 14, namely downstream from the combustion gas. The burners 2 and secondary fuel nozzles 12 which are mounted on the front wall 1b in FIGS. 3 and 4 may be mounted alternatively on the top wall or bottom wall.

Figure 7:
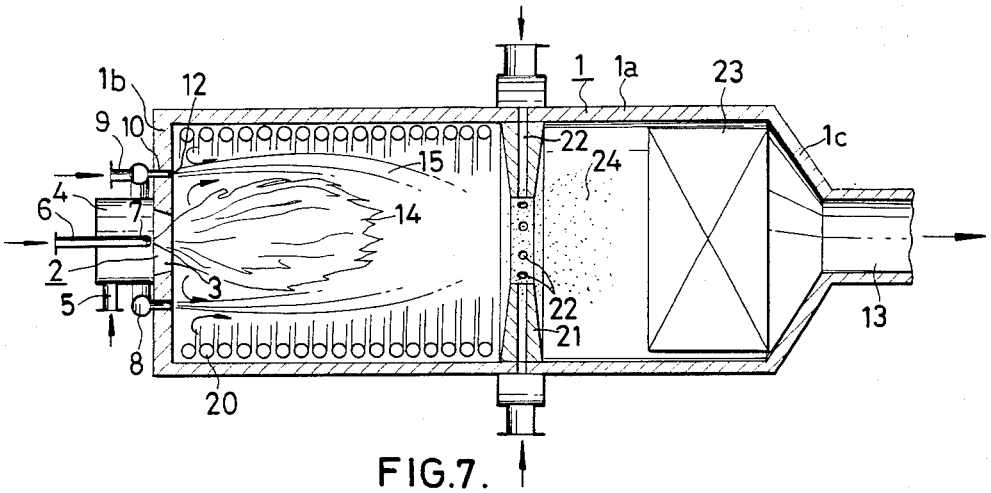
FIG. 7 is a view in vertical section showing a combustion furnace useful for the method of a second embodiment of this invention.

A second embodiment of this invention will be described below. FIG. 7 shows a combustion furnace useful for this embodiment. The furnace is provided in its interior with a helical heat absorbing tube 20 extending along the peripheral wall 1*a* and with a constricting wall 21 positioned at the midportion of its length. A large number of secondary air supply ports 22 extend radially through the constricting wall 21. Heat recovering means 23 is provided in the rear portion of the interior of the furnace.

A primary fuel is supplied to the furnace through a nozzle 7. Primary air is supplied to the furnace through an air inlet 3 at a rate in excess of the stoichiometric rate required for the combustion of the primary fuel, preferably in an air ratio of at least 1.4 at which prompt NO will not be formed. The burner 2 burns the fuel, forming a first-stage combustion zone 14 within the furnace coaxially therewith. As in the first embodiment, the primary fuel may preferably be admixed with the air prior to combustion as with swivelling blades provided in an air box 4 for circling the air.

As already described with reference to the first embodiment, the formation of $NO_x$ is inhibited in the first-stage combustion zone 14. Especially with the second embodiment, the heat absorbing tube 20 which absorbs the heat of combustion maintains a greatly reduced combustion temperature, producing an improved inhibitive effect on the formation of $NO_x$. In this state, a secondary fuel is injected into the furnace through the nozzles 12 at a rate in excess of the stoichiometric rate required for the consumption of the excess oxygen resulting from the combustion in the first-stage zone 14. The injected secondary fuel burns moderately as stated with reference to the first embodiment and forms a second-stage combustion zone 15 around the first-stage combustion zone 14. Particularly with the present embodiment, the heat absorbing tube 20 maintains a reduced combustion temperature in the second-stage zone 15, while the secondary fuel is supplied at an excessive rate as described above, with the result that the combustion takes place in a reducing atmosphere with the formation of $NO_x$ inhibited more effectively. Additionally the reducing atmosphere permits carbon monoxide, hydrogen and like components to remain unburned in the combustion gas. These unburned substances reduce the fuel NO in the combustion gas to nitrogen gas, thus eliminating the fuel NO.

Secondary air is supplied to the furnace through the air supply ports 22 downstream of the combustion gas in the second-stage zone 15 thus formed. The secondary air is supplied at a rate substantially equal to the stoichiometric rate required for the oxidation of the components remaining unburned after the combustion in the second-stage zone 15. The unburned components are oxidized at a temperature preferably of 800° to 1,000° C. at which the oxidation process proceeds without any additional heating from outside and without yielding fuel NO in the presence of the secondary air. The secondary air supply forms a third-stage combustion zone 24 downstream from the second-stage combustion zone 15. The reaction between the air and unburned components in the zone 24 takes place at a low temperature as described above and therefore produces no $NO_x$. The combustion gas, deprived of heat by the heat recovering means 23, is released from the system via the outlet 13.

Figure 11:
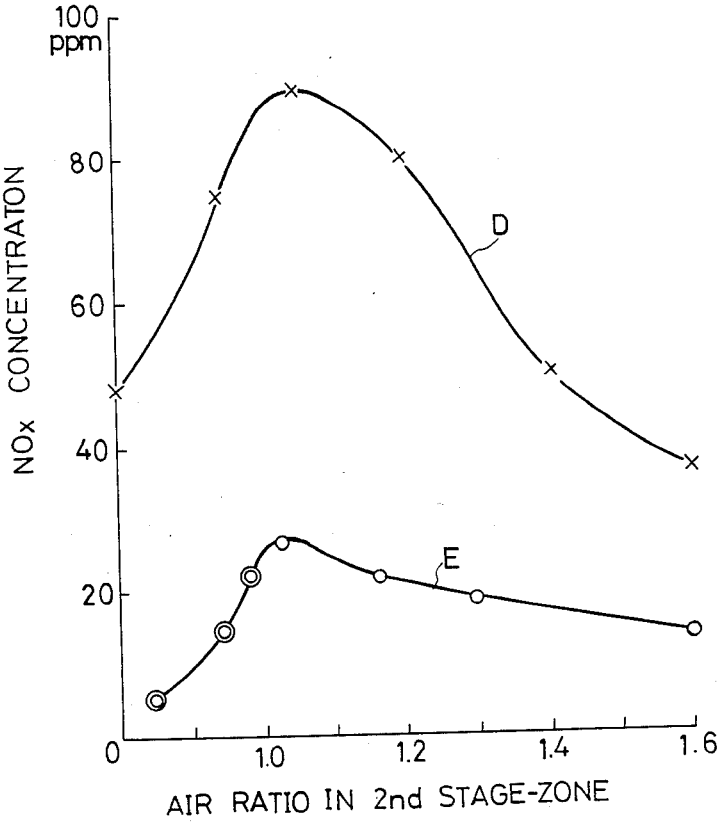
FIG. 11 is a graph showing the relation between the air ratio and the $NO_x$ concentration in a second-stage combustion zone.

The burner shown in FIG. 7 was operated according to the second embodiment while varying the air ratio in the second-stage combustion zone 15 to test the furnace for the $NO_x$ inhibiting effect. Propane gas was used as the fuel. With reference to FIG. 11 showing the test results, Curve D represents the results achieved by single-stage combustion (with use of primary fuel only without any secondary fuel supply) and Curve E those resulting from the use of both the primary and secondary fuels (the ratio of secondary fuel supply to total fuel supply: 0.45). The secondary air was supplied when the air ratio in the second-stage combustion zone 15 is less than 1.15 to maintain an air ratio of 1.15 at the combustion gas outlet 13. FIG. 11 reveals that both Curves D and E have a peak at an air ratio of about 1.0 to 1.05 but that Curve E represents greatly inhibited $NO_x$ formation. When the second-stage combustion zone 15 has a reducing atmosphere (up to 1.0 in air ratio) with the secondary air forming a third-stage combustion zone 24, $NO_x$ can be remarkably inhibited as indicated by double circle marks on Curve E. The portion of Curve D in the air ratio range of not higher than 1.0 corresponds to the conventional combustion method in which air is supplied in two stages. Therefore the method of the second embodiment produces much high inhibitive effects on $NO_x$ than the conventional method.

Figure 8:
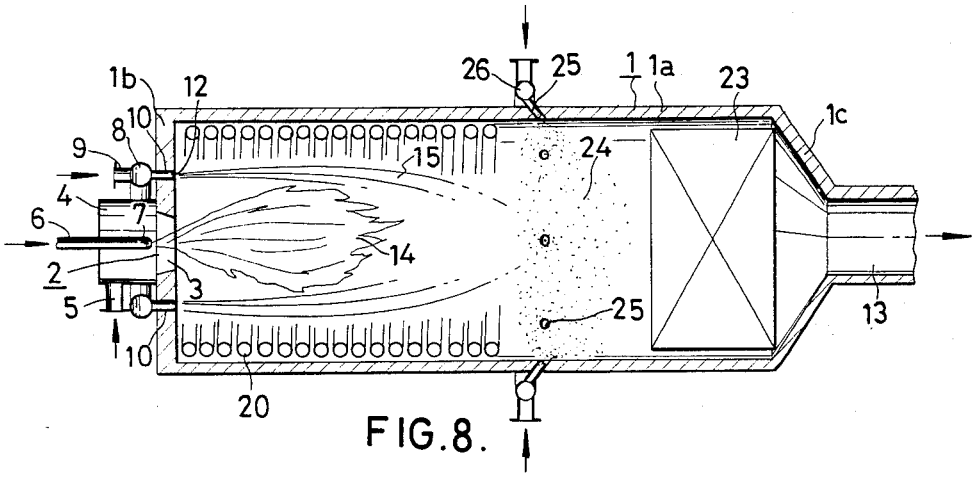
FIG. 8 is a view in vertical section showing the furnace of FIG. 7 equipped with modified means for supplying secondary air.

The secondary air may be supplied to the furnace through a large number of supply pipes 25 installed in the peripheral wall 1*a* of the furnace and inclined obliquely rearward toward its interior as shown in FIG. 8. Indicated at 26 is a header for the pipes 25.

Figure 9:
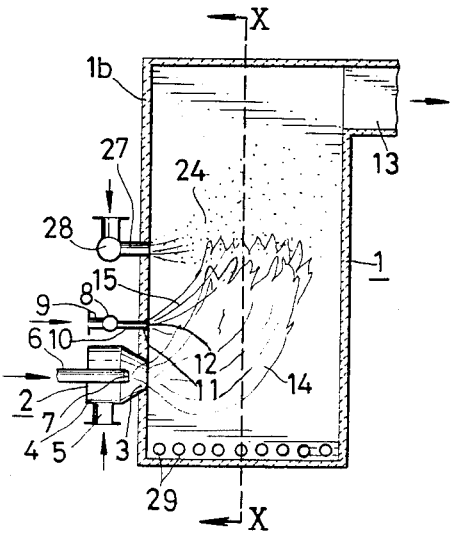
FIG. 9 is a view in vertical section showing a large-sized box furnace useful for the method of the second embodiment.
Figure 10:
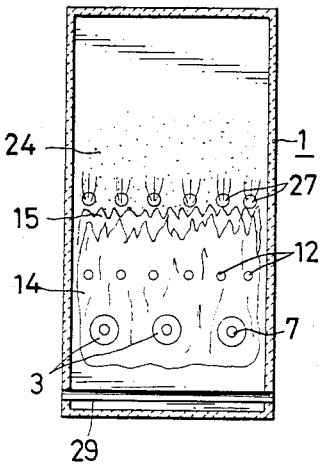
FIG. 10 is a view taken along the line X—X in FIG. 9.

The method of the second embodiment can be practiced with use of a large-sized box furnace as shown in FIGS. 9 and 10 and made of refractory material. The furnace has a row of secondary fuel nozzles 12 at a lower portion of its front wall 1*b* and six secondary air supply pipes 27 arranged in a row above and in parallel to the row of nozzles. Indicated at 28 is a header for the pipes, and at 29 heat absorbing tubes provided on the bottom of the furnace. With use of the box furnace, the secondary air supplied through the pipes 27 forms a third-stage combustion zone 24 downstream from the second-stage combustion zone 15. The burner 2, secondary fuel nozzles 12 and secondary air supply pipes 27, which are mounted on the front wall 1*b*, may alternatively be mounted on the top wall or bottom wall.

What is claimed is:

1. A multi-stage combustion method for inhibiting the formation of nitrogen oxides comprising injecting a primary fuel and primary air into a furnace at an upstream end thereof to burn the fuel and form a first-stage combustion zone downstream of said end, the primary air being supplied at a rate in excess of the stoichiometric rate required for the combustion of the primary fuel, so that a ratio of air actually provided to air stoichiometrically required for combustion is at least 1.4 in the first-stage combustion zone, and injecting only a secondary fuel in the absense of air into the furnace at said upstream end in a plurality of streams spaced from a location of injecting said primary fuel and primary air into the vicinity of the first-stage combustion zone at a rate approximately equal to the stoichiometric rate required for the consumption of the excess oxygen resulting from the combustion in the first-stage zone and diluting the secondary fuel with surrounding combustion gas prior to combusting with said excess oxygen to form a second stage combustion zone spaced from a location of injecting of said plurality of streams and in the vicinity of the first-stage zone.

2. A method as defined in claim 1 wherein the secondary fuel is injected around the first-stage zone.

3. A method as defined in claim 1 wherein the secondary fuel is injected toward a location downstream of the combustion gas of the first-stage zone.

4. A method as defined in claim 1 wherein the secondary fuel is supplied to the furnace diluted with combustion gas.

5. A method as defined in claim 1 wherein the primary fuel is mixed with air prior to combustion.

6. A method as defined in claim 1 wherein the primary air is supplied at a rate equal to the stoichiometric rate required for the combustion of the whole amount of fuel supplied to the furnace.

* * * * *